US012540609B2

(12) United States Patent
Yang et al.

(10) Patent No.: US 12,540,609 B2
(45) Date of Patent: Feb. 3, 2026

(54) COMPRESSOR AND HOME APPLIANCE INCLUDING THE SAME

(71) Applicant: Samsung Electronics Co., Ltd., Suwon-si (KR)

(72) Inventors: Eunho Yang, Suwon-si (KR); Mincheol Yun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/753,531

(22) Filed: Jun. 25, 2024

(65) Prior Publication Data

US 2025/0092867 A1 Mar. 20, 2025

Related U.S. Application Data

(63) Continuation of application No. PCT/KR2024/008216, filed on Jun. 14, 2024.

(30) Foreign Application Priority Data

Sep. 19, 2023 (KR) ..... 10-2023-0125046

(51) Int. Cl.
*F04B 39/02* (2006.01)
*F04B 35/04* (2006.01)

(52) U.S. Cl.
CPC ..... *F04B 39/0246* (2013.01); *F04B 35/04* (2013.01)

(58) Field of Classification Search
CPC ..... F04B 39/0246; F04B 35/04
USPC ..... 184/6.28
See application file for complete search history.

(56) References Cited

U.S. PATENT DOCUMENTS 3,830,341 A * 8/1974 Davies ..... F04B 39/0253 417/372
3,848,702 A * 11/1974 Bergman ..... F16N 7/366 418/94
6,450,785 B1 * 9/2002 Dellby ..... F04B 39/0261 417/372
6,666,301 B2 * 12/2003 Kim ..... F16N 7/366 184/6.16
6,716,001 B2 * 4/2004 Kim ..... F04B 39/0246 417/424.2

(Continued)

FOREIGN PATENT DOCUMENTS

CN 1455096 A 11/2003
CN 206707971 U 12/2017

(Continued)

OTHER PUBLICATIONS

International Search Report and Written Opinion dated on Sep. 11, 2024, issued in International Application No. PCT/KR2024/008216.

*Primary Examiner* — Henry Y Liu
(74) *Attorney, Agent, or Firm* — Jefferson IP Law, LLP

(57) ABSTRACT

A compressor according to an example of the disclosure may comprise a case storing oil in a lower portion thereof, a stator disposed in the case, a rotor rotated by an electromagnetic interaction with the stator, a rotation shaft coupled with the rotor, and having a hollow portion therein, and an oil pickup part having one end received in the hollow portion and the other end fixed to the stator, wherein the oil pickup part may include a bridge portion connecting the one end and the other end, and at least a portion of which is bent multiple times.

20 Claims, 9 Drawing Sheets

(56) References Cited

U.S. PATENT DOCUMENTS

| | | | | |
|---|---|---|---|---|
| 7,832,994 | B2 * | 11/2010 | Akashi | F04B 39/0253 417/415 |
| 8,202,067 | B2 * | 6/2012 | Klein | F04B 39/0246 417/372 |
| 8,801,399 | B2 * | 8/2014 | Kim | F04B 39/0261 184/6.16 |
| 8,920,134 | B2 * | 12/2014 | Akbas | F04B 39/122 60/330 |
| 9,297,372 | B2 * | 3/2016 | Kim | F04B 39/0246 |
| 9,617,985 | B2 * | 4/2017 | Park | F04B 39/0284 |
| 2002/0170778 | A1 * | 11/2002 | Kim | F04B 39/0246 184/6.16 |
| 2002/0172607 | A1 * | 11/2002 | Kim | F04B 39/0044 417/366 |
| 2004/0151604 | A1 * | 8/2004 | Ishida | F04B 39/0253 417/372 |
| 2005/0115771 | A1 * | 6/2005 | Shin | F04B 39/023 184/6.16 |
| 2006/0013706 | A1 * | 1/2006 | Ishida | F04B 39/0261 417/365 |
| 2007/0020126 | A1 * | 1/2007 | Shin | F04B 39/0094 417/415 |
| 2012/0107154 | A1 * | 5/2012 | Akbas | F16H 41/00 417/410.1 |
| 2013/0309119 | A1 * | 11/2013 | Kim | F04B 39/0261 418/55.6 |
| 2019/0178240 | A1 * | 6/2019 | Nam | F04B 35/04 |
| 2022/0170475 | A1 * | 6/2022 | Park | F04B 39/0246 |

FOREIGN PATENT DOCUMENTS

| | | | |
|---|---|---|---|
| EP | 2 212 558 | B1 | 6/2011 |
| EP | 2 724 026 | B1 | 5/2016 |
| KR | 10-0195944 | B1 | 6/1999 |
| KR | 10-2009-0079965 | A | 7/2009 |
| KR | 10-2012-0136537 | A | 12/2012 |
| KR | 10-1480466 | B1 | 1/2015 |
| KR | 10-1483519 | B1 | 1/2015 |
| KR | 10-1910656 | B1 | 10/2018 |
| KR | 10-1991580 | B1 | 6/2019 |
| KR | 10-2186246 | B1 | 12/2020 |
| KR | 10-2491596 | B1 | 1/2023 |
| WO | 96/29516 | A1 | 9/1996 |

* cited by examiner

COMPRESSOR AND HOME APPLIANCE INCLUDING THE SAME

CROSS-REFERENCE TO RELATED APPLICATION(S)

This application is a continuation application, claiming priority under § 365(c), of International application No. PCT/KR2024/008216, filed on Jun. 14, 2024, which is based on and claims the benefit of a Korean patent application number 10-2023-0125046, filed on Sep. 19, 2023, in the Korean Intellectual Property Office, the disclosures of which is incorporated by reference herein in its entirety.

BACKGROUND

1. Field

The disclosure relates to an oil pickup part for cooling and lubrication of a hermetic reciprocating compressor.

2. Description of Related Art

A compressor is a mechanical device that increases the pressure of a gas by reducing its volume. Compressors are largely divided into a positive displacement type, in which the volume of fluid changes, and a turbo type, in which the speed of fluid changes. Between the two (2) types, positive displacement compressors are widely used in small and medium-sized capacities. Positive displacement compressors are further divided into reciprocating compressors and rotating compressors depending on the operation method.

A reciprocating compressor is a compressor that sucks (e.g., intake) and compresses gas by converting the rotation of the motor into the linear reciprocating motion of the piston within the cylinder through the crankshaft and connecting rod.

Rotating compressors include rotary compressors in which a roller is rotated in the cylinder by rotation of a motor to suck or compress gas and scroll compressors that suck and compress gas continuously while spin-scroll-orbiting in a certain direction from a fixed scroll center by rotation of a motor.

Among reciprocating compressors, hermetic reciprocating compressors are compressors in which an electric mechanism, such as a motor, and a compression mechanism, such as a piston, are provided inside a single case. Oil for lubrication and cooling of components, such as the electric mechanism or compression mechanism, is stored inside the case.

A hermetic reciprocating compressor includes a rotation shaft for transferring the rotational force of the motor to the piston, and a pickup shaft that is received in a hollow portion of the rotation shaft to raise the oil stored in the case.

When the compressor operates, the inner circumstantial side (e.g., surface) of the rotation shaft and the pickup shaft collide due to vibration transferred from the main body of the compressor to the pickup shaft, causing noise.

The above information is presented as background information only to assist with an understanding of the disclosure. No determination has been made, and no assertion is made, as to whether any of the above might be applicable as prior art with regard to the disclosure.

SUMMARY

Various embodiments are to address at least the above-mentioned problems and/or disadvantages and to provide at least the advantages described below. Accordingly, various embodiments of the disclosure may provide a compressor including an oil pickup part having a bridge structure for attenuating the vibration transferred from a compressor main body when the compressor operates.

Various aspects will be set forth in part in the description which follows and, in part, will be apparent from the description, or may be learned by practice of the presented embodiments.

A compressor according to an example of the disclosure may comprise a case storing oil in a lower portion thereof, a stator disposed in the case, a rotor rotated by an electromagnetic interaction with the stator, a rotation shaft coupled with the rotor, and having a hollow portion therein, and an oil pickup part having one end received in the hollow portion and the other end fixed to the stator. The oil pickup part may include a bridge portion connecting the one end, and at least a portion of which is the other end and bent multiple times.

According to various embodiments of the disclosure, the bridge portion of the oil pickup part connecting the fixing portion fixed to the compressor main body and the pickup shaft received in the hollow portion of the rotation shaft may be bent multiple times to form the damper portion, thereby attenuating the vibration transferred from the compressor main body to the oil pickup part when the compressor operates. Accordingly, the frequency of collision between the inner circumferential side (e.g., surface) of the rotation shaft and the outer circumferential side (e.g., surface) of the pickup shaft when the compressor operates may be reduced, overall reducing the noise due to the operation of the compressor.

A home appliance including a refrigeration cycle for heat exchange with an outside using a refrigerant, according to an embodiment of the disclosure, may include a compressor compressing the refrigerant. The compressor may include a case storing oil in a lower portion thereof, a stator disposed in the case, a rotor rotated by an electromagnetic interaction with the stator, a rotation shaft coupled with the rotor, and having a hollow portion therein, and an oil pickup part having one end received in the hollow portion and the other end fixed to the stator. The oil pickup part may include a bridge portion connecting the one end and the other end, and at least a portion of which is bent multiple times.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same or similar reference denotations may be used to refer to the same or similar elements throughout the specification and the drawings.

DETAILED DESCRIPTION

Figure 1:
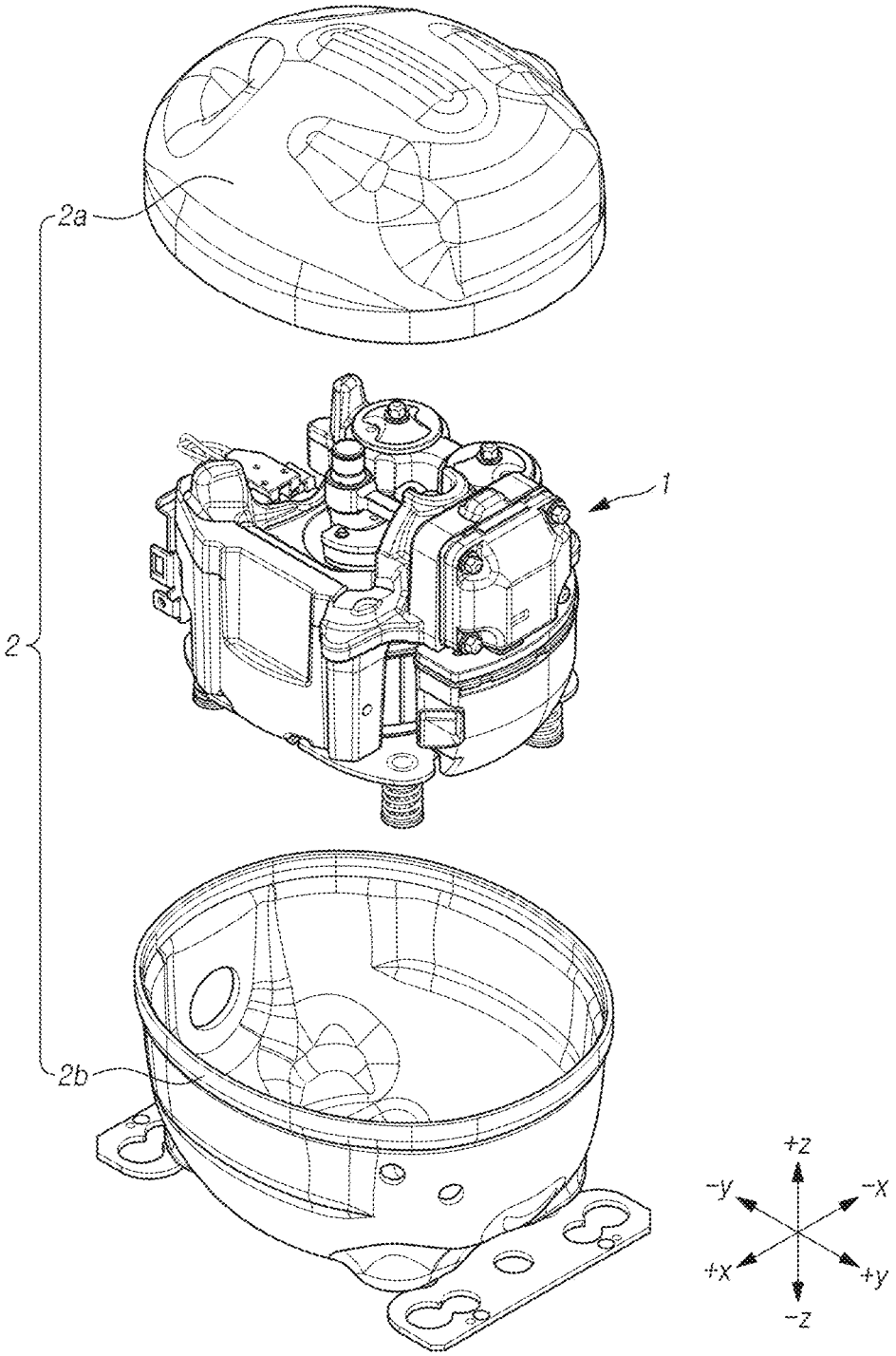
FIG. 1 is a perspective view illustrating a hermetic reciprocating compressor according to an example embodiment of the disclosure.

It should be appreciated that various embodiments of the disclosure and the terms used therein are not intended to limit the technological features set forth herein to particular embodiments and include various changes, equivalents, or replacements for a corresponding embodiment.

With regard to the description of the drawings, similar reference numerals may be used to refer to similar or related elements.

It is to be understood that a singular form of a noun corresponding to an item may include one or more of the things, unless the relevant context clearly indicates otherwise.

As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases.

As used herein, such terms as "1st" and "2nd," or "first" and "second" may be used to simply distinguish a corresponding component from another, and does not limit the components in other aspect (e.g., importance or order).

It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

It will be further understood that the terms "comprise" and/or "have," as used herein, specify the presence of stated features, integers, steps, operations, elements, and/or components, but do not preclude the presence or addition of one or more other features, integers, steps, operations, elements, components, and/or groups thereof.

It will be understood that when a component is referred to as "connected to," "coupled to", "supported on," or "contacting" another component, the components may be connected to, coupled to, supported on, or contact each other directly or via a third component.

Throughout the specification, when one component is positioned "on" another component, the first component may be positioned directly on the second component, or other component(s) may be positioned between the first and second component.

The term "and/or" may denote a combination(s) of a plurality of related components as listed or any of the components.

Hereinafter, the working principle and embodiments of the disclosure are described with reference to the accompanying drawings.

The compressor 1 described in the disclosure may perform a compression cycle among four (4) cycles of compression, condensation, expansion, and evaporation of the refrigeration cycle. The compressor 1 may be used in various home appliances such as an air conditioner, a refrigerator, or a freezer having a refrigeration cycle. For a better understanding of the disclosure, the following description focuses primarily on a hermetic reciprocating compressor 1, but, without limitations thereto, various changes may be made thereto so that the disclosure is applied to rotary compressors or scroll compressors.

FIG. 1 is a perspective view illustrating a hermetic reciprocating compressor according to an example embodiment of the disclosure.

Referring to FIG. 1, a compressor 1 according to an example may be a hermetic reciprocating compressor in which a motor (e.g., the motor 10 of FIG. 2), to be described below, is sealed (e.g., airtight or gas tight) and received in a case 2.

According to an example, the case 2 may be formed of a metal material. In an example, the case 2 may be manufactured by performing plastic working on a steel sheet by a deep drawing method or the like. For example, the case 2 may be manufactured by welding two (2) iron plate structures manufactured in a hemispherical shape. When manufacturing the case 2, pressing (e.g., pressing method or pressing operation) may be used to manufacture an iron plate sheet having a predetermined thickness in a hemispherical shape.

According to an example, the case 2 may include an upper case 2*a* and a lower case 2*b*. In an example, the compressor 1 may be sealed from the outside by coupling the upper case 2*a* and the lower case 2*b* while being received in the lower case 2*b*.

According to an example, although not specifically illustrated in the drawings, oil for lubricating and cooling between various components of the compressor 1 may be stored in a lower portion of the case 2, e.g., inside the lower case 2*b*.

Figure 2:
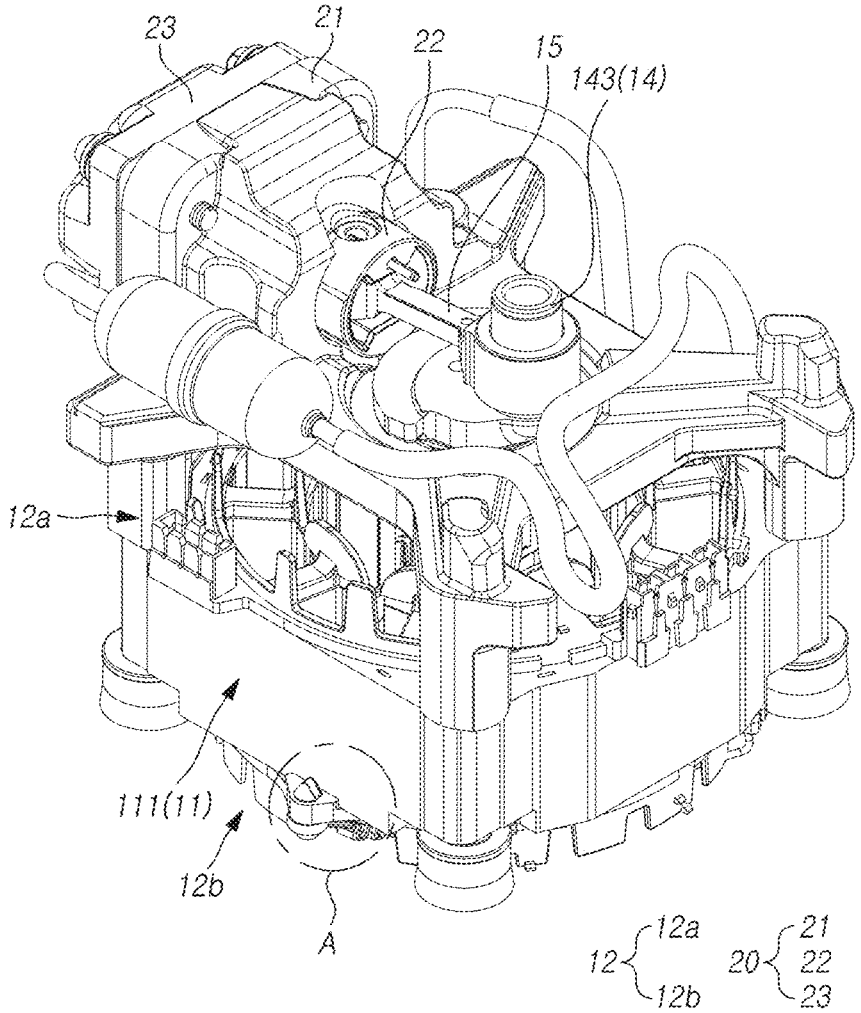
FIG. 2 is a perspective view illustrating the compressor with the case removed in FIG. 1 according to an embodiment of the disclosure.

FIG. 2 is a perspective view illustrating the compressor with the case removed in FIG. 1 according to an embodiment of the disclosure.

Figure 3:
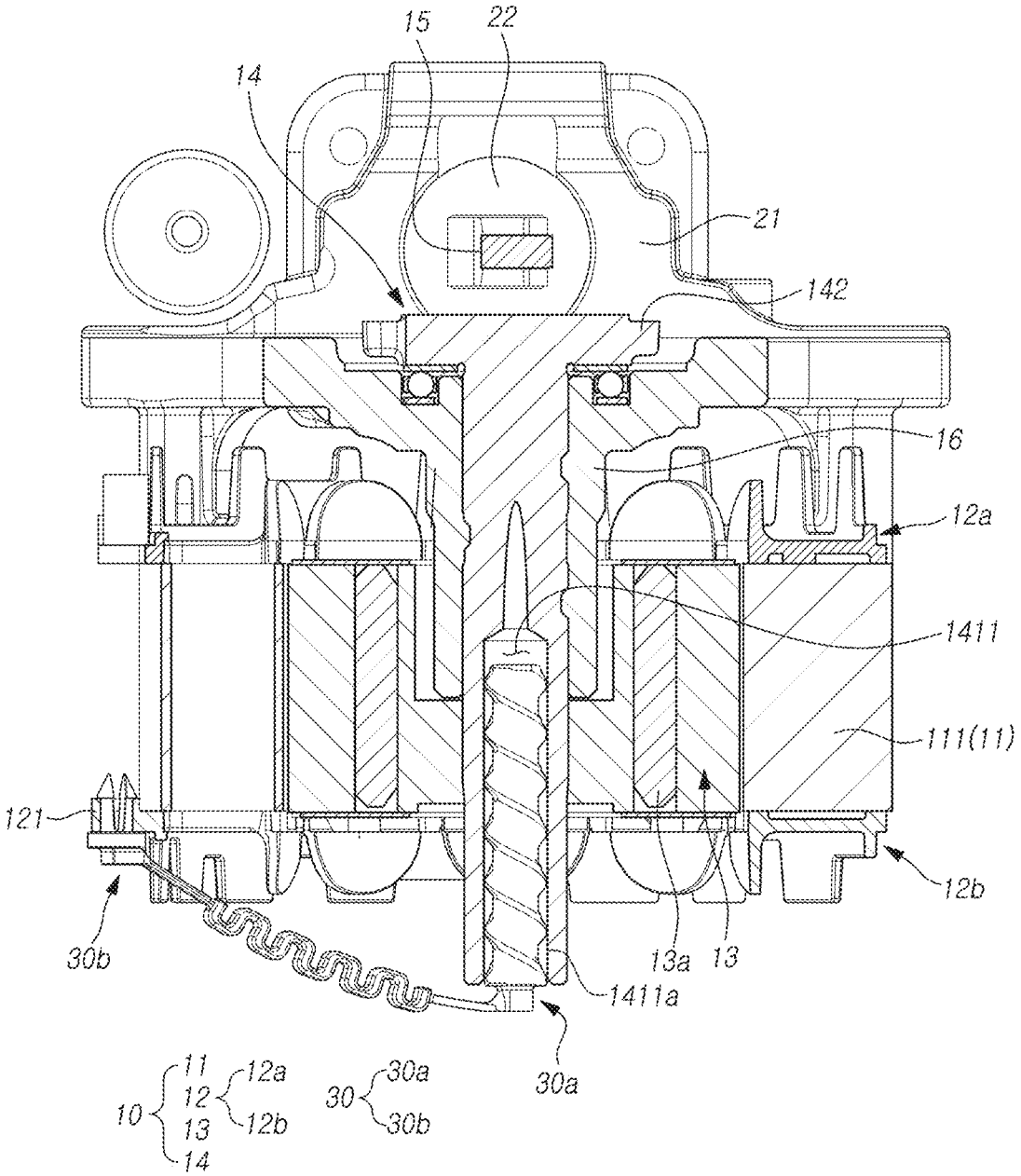
FIG. 3 is a cross-sectional view illustrating the compressor of FIG. 2 according to an embodiment.

FIG. 3 is a cross-sectional view illustrating the compressor of FIG. 2 according to an embodiment of the disclosure.

Referring to FIGS. 2 and 3, the compressor 1 according to an example may include a motor 10, a cylinder block 20, and an oil pickup part 30.

According to an example, the motor 10 may be coupled to a lower side of the cylinder block 20.

According to an example, the motor 10 may include a stator 11, an insulator 12, a rotor 13, and a rotation shaft 14 coupled to the rotor 13.

According to an example, the stator 11 may be coupled to a lower side of the cylinder block 20 through a fastening member (e.g., a bolt). In an example, the stator 11 may include a stator core 111 having a cylindrical shape and formed of a metal material and a stator coil (not shown) wound (e.g., wrapped or provided) around the stator core 111. If a voltage is applied to the stator coil, the stator 11 may electromagnetically interact with the rotor 13 as an electromagnetic force is generated.

According to an example, the insulator 12 may be disposed between the stator core 111 and a stator coil (not shown). According to an example, the insulator 12 may include an upper insulator 12*a* disposed above the stator 11 (specifically, the stator core 111) and a lower insulator 12*b* disposed below the stator 11 (specifically, the stator core 111). For example, the stator coil may be wound (e.g., wrapped or provided) to substantially surround the stator core 111 and the insulator 12.

Direct contact between the stator core 111 and the stator coil may be blocked by the insulator 12. If the stator coil and the stator core 111 directly contact each other, generation of an electromagnetic force from the stator coil may be hindered, and thus it may necessary to separate the stator core 111 and the stator coil by a predetermined distance through the insulator 12.

According to an example, the lower insulator 12*b* may include a coupling portion 121 provided with a coupling hole 1211 into which the fixing portion 33 of the oil pickup part 30, which is described below, is inserted (see FIG. 6). In the disclosure, an example in which the coupling portion 121 is provided in the insulator 12 (specifically, the lower insulator 12*b*) is described, but the disclosure is not limited thereto, and the coupling portion may be provided as a separate member (e.g., bracket).

According to an example, the rotor 13 may be disposed inside the stator 11. As such, the motor 10 in which the rotor 13 is disposed inside the stator 11 may be referred to as an inner rotor type motor 10. In the disclosure, the inner rotor type motor 10 is described as an example, but the disclosure is not limited thereto. In an example, the motor may be implemented in an outer rotor type in which the rotor is disposed outside the stator.

According to an example, the rotor 13 may be rotatably disposed inside the stator 11. In an example, the rotor 13 may include a plurality of magnets 13*a* inserted and mounted inside the rotor 13 (e.g., a rotor core). In this case, if a voltage is applied to the stator 11, the rotor 13 may rotate through electromagnetic interaction with the stator 11.

According to an example, the lower end of the rotation shaft 14 may be coupled to the rotor 13, and the upper end of the rotation shaft 14 may be coupled to the connecting rod 15. In this case, the rotation shaft 14 may transfer the rotational force of the motor 10 to the cylinder 21, to be described below, when the motor 10 rotates.

According to an example, the rotation shaft 14 may include a central shaft 141 and an eccentric shaft 143. In an example, the central shaft 141 may be coupled to the rotor 13. In an example, the eccentric shaft 143 may be coupled to one end of the connecting rod 15. In an example, the other end of the connecting rod 15 may be coupled to the piston 22 inserted into a compression chamber (not shown) of the cylinder 21, which is described below. In an example, the connecting rod 15 may convert the rotational motion of the motor 10 into a linear reciprocating motion (or a forward and backward motion) of the piston 22 disposed in the compression chamber to be described below.

According to an example, the rotation shaft 14 may have a hollow portion 1411 to raise the oil stored in the case 2 through the inner circumferential side (e.g., surface). In an example, the hollow portion 1411 may be provided in a lower portion of the central shaft 141.

According to an example, the cylinder block 20 may include a cylinder 21 provided with a cylindrical compression chamber (not shown) therein, a piston 22 inserted into the compression chamber to reciprocate, and a valve assembly 23 provided on one side of the cylinder 21.

According to an example, the cylinder 21 may have a hexahedral shape. In an example, the cylinder 21 may include a cylindrical compression chamber penetrating the center of the cylinder 21.

According to an example, the piston 22 may be inserted into the compression chamber of the cylinder 21. In an example, the piston 22 may be coupled to the connecting rod 15 behind the cylinder 21. The piston 22 may reciprocate back and forth inside the compression chamber through the connecting rod 15 when the motor 10 rotates. The volume of the inner space of the compression chamber may be changed by the back-and-forth reciprocating motion of the piston 22, and the gas (e.g., refrigerant) may be sucked (e.g., introduced or flowed) into the inner space of the compression chamber or the sucked gas may be compressed.

According to an example, the valve assembly 23 may be coupled to the outside of the cylinder 21. In an example, the valve assembly 23 may be disposed in front of the cylinder 21 to cover the compression chamber of the cylinder 21. In an example, the valve assembly 23 may include a suction valve (not shown) and a discharge valve (not shown) and may suck (e.g., introduce) gas into the compression chamber or discharge gas out of the compression chamber according to the back-and-forth reciprocating motion of the piston 22.

According to an example, when the rotation shaft 14 rotates, the oil pickup part 30 may interact with the rotation shaft 14 to cause the oil stored under the case 2 to rise. According to an example, one end (or first end) 30*a* of the oil pickup part 30 may be inserted into the hollow portion 1411 of the rotation shaft 14. According to an example, the other end (or second end) 30*b* of the oil pickup part 30 may be fixed to the insulator 12 (specifically, the lower insulator 12*b*).

A specific function, shape, and/or structure of the oil pickup part 30 is described in detail with reference to FIGS. 4 to 6.

Figure 4:
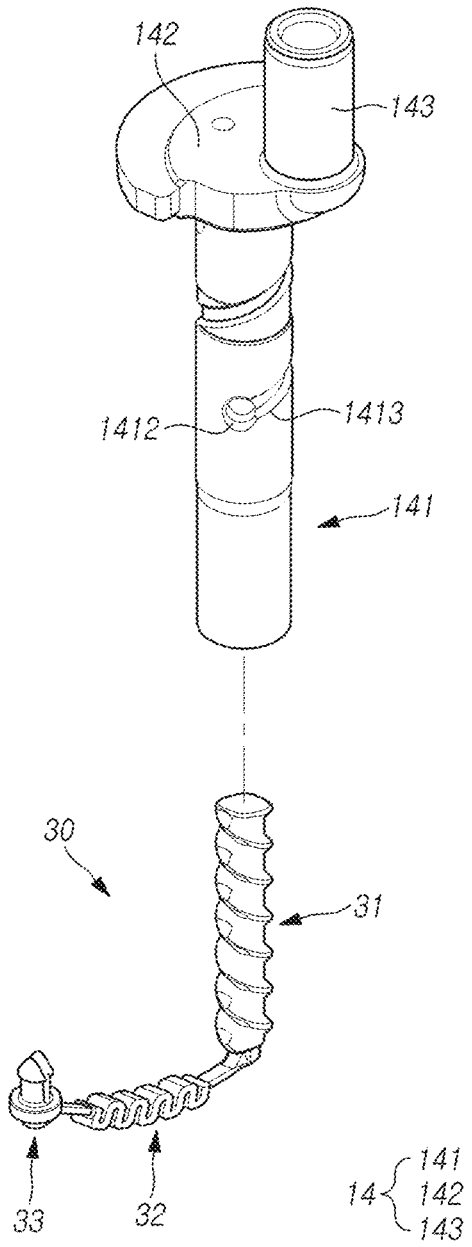
FIG. 4 is a view illustrating a state in which a rotation shaft and an oil pickup part are separated according to an example of the disclosure.

FIG. 4 is a view illustrating a state in which a rotation shaft and an oil pickup part are separated according to an example embodiment of the disclosure.

Figure 5:
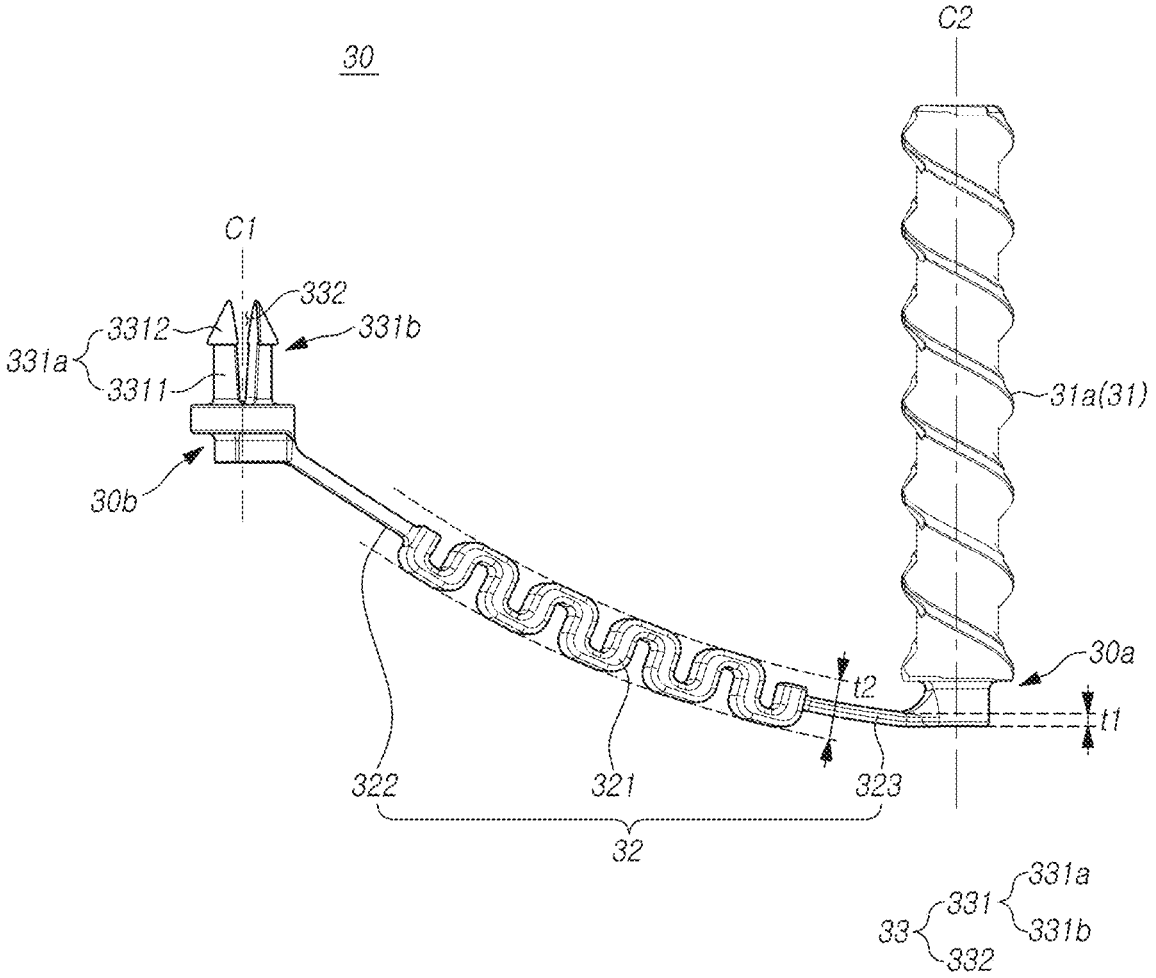
FIG. 5 is a front view illustrating an oil pickup part according to an example of the disclosure.

FIG. 5 is a front view illustrating an oil pickup part according to an example embodiment of the disclosure.

Figure 6:
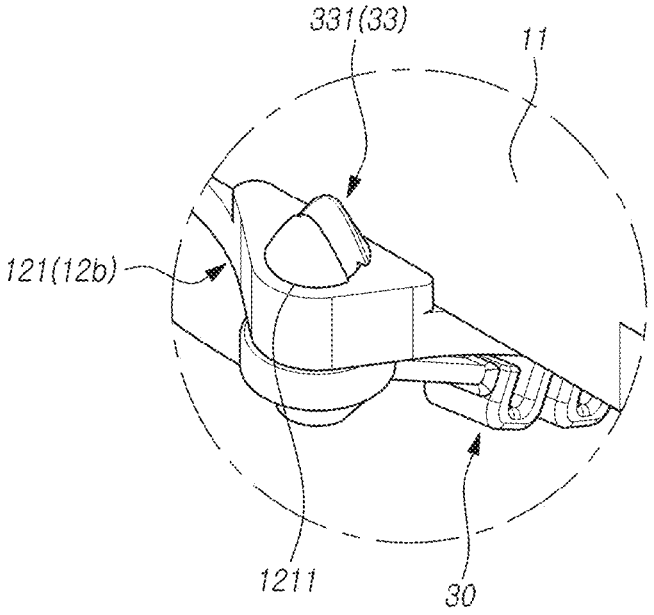
FIG. 6 is an enlarged view of portion A of FIG. 2 according to am embodiment of the disclosure.

FIG. 6 is an enlarged view of portion A of FIG. 2 according to an embodiment of the disclosure.

Referring to FIGS. 4 to 6, the rotation shaft 14 according to an example may include a central shaft 141, a disk portion 142, and an eccentric shaft 143.

According to an example, the central shaft 141 may extend downward from the disk portion 142. For example, the central shaft 141 may extend downward from the center of the disk portion 142.

According to an example, the central shaft 141 may include at least one communication hole 1412 formed in the outer circumferential side (e.g., surface) of the central shaft 141 and communicating with the hollow portion 1411, and a spiral groove 1413 extending from the communication hole 1412 in the axial direction (e.g., the upper/lower direction) of the central shaft 141.

According to an example, the disk portion 142 may extend radially and may be connected to each of the central shaft 141 and the eccentric shaft 143.

According to an, the eccentric shaft 143 may extend upward of the disk portion 142. For example, the eccentric shaft 143 may be formed to extend upward at a position outside the center of the disk portion 142.

The oil pickup part 30, according to an example, may include a pickup shaft 31, a bridge portion 32, and a fixing portion 33.

According to an example, the pickup shaft 31 may be positioned at one end 30*a* of the oil pickup part 30 and may be received in the hollow portion 1411 of the rotation shaft 14.

According to an example, the pickup shaft 31 may include a spiral blade 31*a* that is formed on the outer circumferential side (e.g., surface) of the pickup shaft 31 to, together with the inner circumferential side (e.g., surface) (1411*a* of FIG. 3) of the rotation shaft 14, raise the oil stored in the case 2. For example, the spiral blade 31*a* may extend from the outer circumferential side (e.g., surface) of the pickup shaft 31 along the axial direction (e.g., the vertical direction) of the pickup shaft 31. The pickup shaft 31 may have a screw shape.

When the rotation shaft 14 rotates, the oil stored in the case 2 may be rotated in the rotation direction of the rotation shaft 14 by an adhesive force with the rotation shaft 14, and may ascend (e.g., move or rise) along the spiral blade 31*a* of the pickup shaft 31. In other words, the centrifugal force due to rotation may be converted into a rising force by the spiral blade 31*a*, so that the oil may ascend (e.g., move or rise).

The oil ascended (e.g., raised) in the hollow portion 1411 may be guided to the spiral groove 1413 through the communication hole 1412. Thereafter, the oil guided to the spiral groove 1413 may descend (e.g., move) along the spiral groove 1413 to lubricate and cool between the outer circumferential side (e.g., surface) of the rotation shaft 14 and the inner circumferential side (e.g., surface) of the shaft support portion 16 of FIG. 3.

According to an example, although not specifically shown in the drawings, the hollow portion 1411 of the rotation shaft 14 may communicate with the eccentric shaft 143 through a separate oil passage (not shown). When the rotation shaft 14 rotates, the oil ascended (e.g., raised) in the hollow portion 1411 may be ascended (e.g., moved or raised) toward the eccentric shaft 143 along the oil passage to lubricate and cool the eccentric shaft 143 and/or the connecting rod 15.

According to an example, the bridge portion 32 may connect the pickup shaft 31 and the fixing portion 33. According to an example, the bridge portion 32 may be bent multiple times in a predetermined section. According to an example, the bridge portion 32 may be designed to have an appropriate thickness t1 to have a degree of freedom for movement (or deformation) during vibration according to the operation of the compressor 1. For example, the thickness t1 of the bridge portion 32 may be set to about 1 mm (or 1 T (thickness)).

According to an example, the bridge portion 32 may include a damper portion 321 bent multiple times and connection portions (e.g., the first connection portion 322 and the second connection portion 323) connected to the pickup shaft 31 and the fixing portion 33 on two (2) opposite sides of the damper portion 321.

According to an example, the damper portion 321 may be bent multiple times to have one of a wavy (e.g., curvy) shape, a wrinkle shape, and a concavo-convex shape. In this case, the overall side (e.g., surface) area length of the bridge portion 32 in the extending direction of the bridge portion 32 may be increased compared to when the damper portion 321 bent multiple times is not provided in the bridge portion 32. As a result, the damper portion 321 may increase the vibration transfer path of the bridge portion 32. Accordingly, when the compressor 1 is operated, vibration transferred to the oil pickup part 30 through the fixing portion 33 may be attenuated by the damper portion 321.

According to an example, the thickness t2 of the damper portion 321 may be designed to be larger than the thickness t1 of the bridge portion 32. The thickness t2 of the damper portion 321 may mean the thickness (or the height difference between ridge and trough) of the upper and lower portions of the damper portion 321 formed as the damper portion 321 is bent multiple times. In this case, if the oil pickup part 30 is moved in the manufacturing process of the compressor 1, the automatic assembly device may grip the damper portion 321, thereby addressing the inapplicability of automatic equipment due to the bridge portion 32 being thinned.

According to an example, the fixing portion 33 may be positioned at the other end 30*b* of the oil pickup part 30. According to an example, the fixing portion 33 may be fittingly coupled to the coupling portion 121 provided in the insulator 12 (specifically, the lower insulator 12*b*). In this case, the pickup shaft 31 may not be rotated by the fixing portion 33 despite the rotation of the rotation shaft 14.

According to an example, the fixing portion 33 may include a pair of fixing protrusions 331 and a deformation space 332 formed between the pair of fixing protrusions. In an example, the pair of fixing protrusions 331 may include a first fixing protrusion 331*a* and a second fixing protrusion 331*b* formed to be symmetrical to each other with the deformation space 332 interposed therebetween.

According to an example, each of the first fixing protrusion 331*a* and the second fixing protrusion 331*b* may include a body portion 3311 and an insertion portion 3312 extending from the body portion 3311 and gradually decreasing in diameter upward. If the fixing portion 33 is fittingly coupled to the coupling portion 121 of the lower insulator 12*b*, the pair of fixing protrusions 331 may be deformed (e.g., changed shape or form) toward the deformation space 332, and when the insertion is completed, the pair of fixing protrusions 331 may be restored to the original shape, and stuck to the coupling portion 121.

According to an example, the pickup shaft 31 and the fixing portion 33 may be disposed side by side with each other. For example, the central shaft C1 of the pickup shaft 31 and the central shaft C2 of the fixing portion 33 may be parallel to each other.

Figure 7:
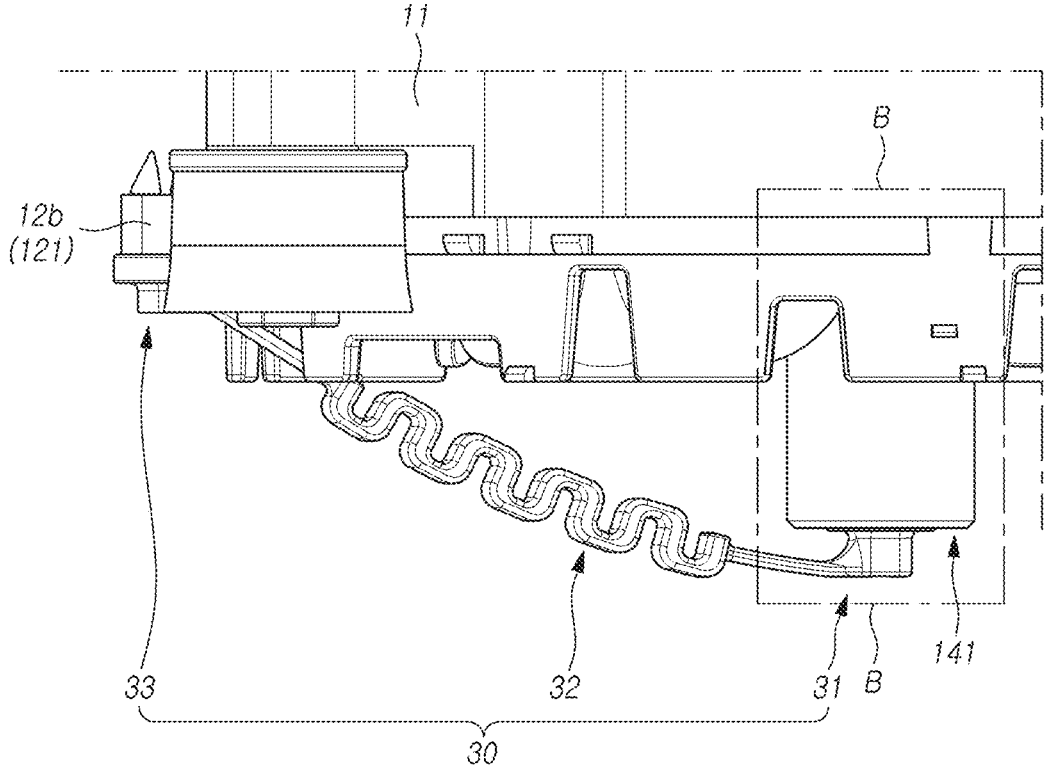
FIG. 7 is a view illustrating a lower portion of a compressor according to an example embodiment of the disclosure.

FIG. 7 is a view illustrating a lower portion of a compressor according to an embodiment of the disclosure.

Figure 8:
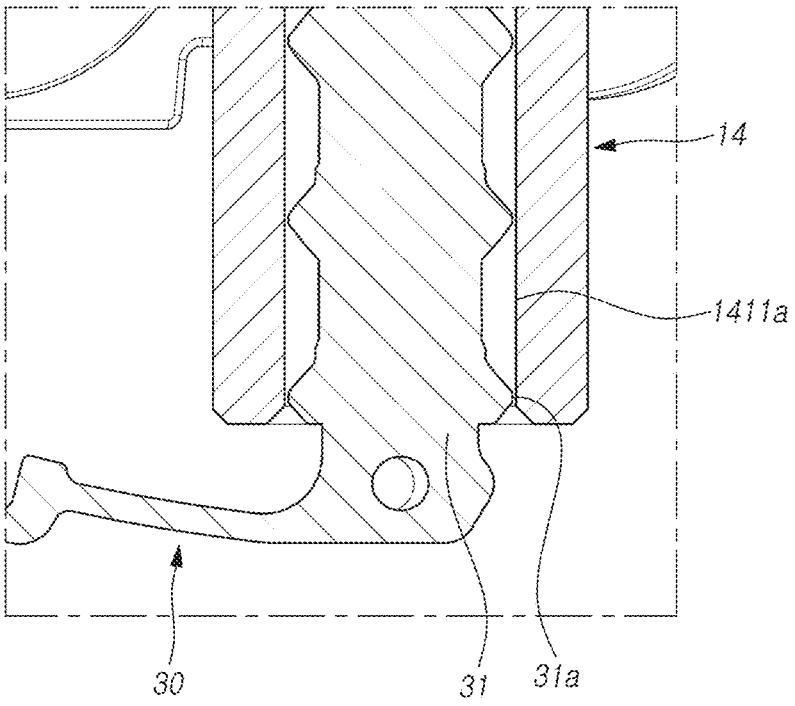
FIG. 8 is an enlarged cross-sectional view illustrating portion B of FIG. 7 according to an embodiment of the disclosure.

FIG. 8 is an enlarged cross-sectional view illustrating portion B of FIG. 7 according to an embodiment of the disclosure.

Figure 9:
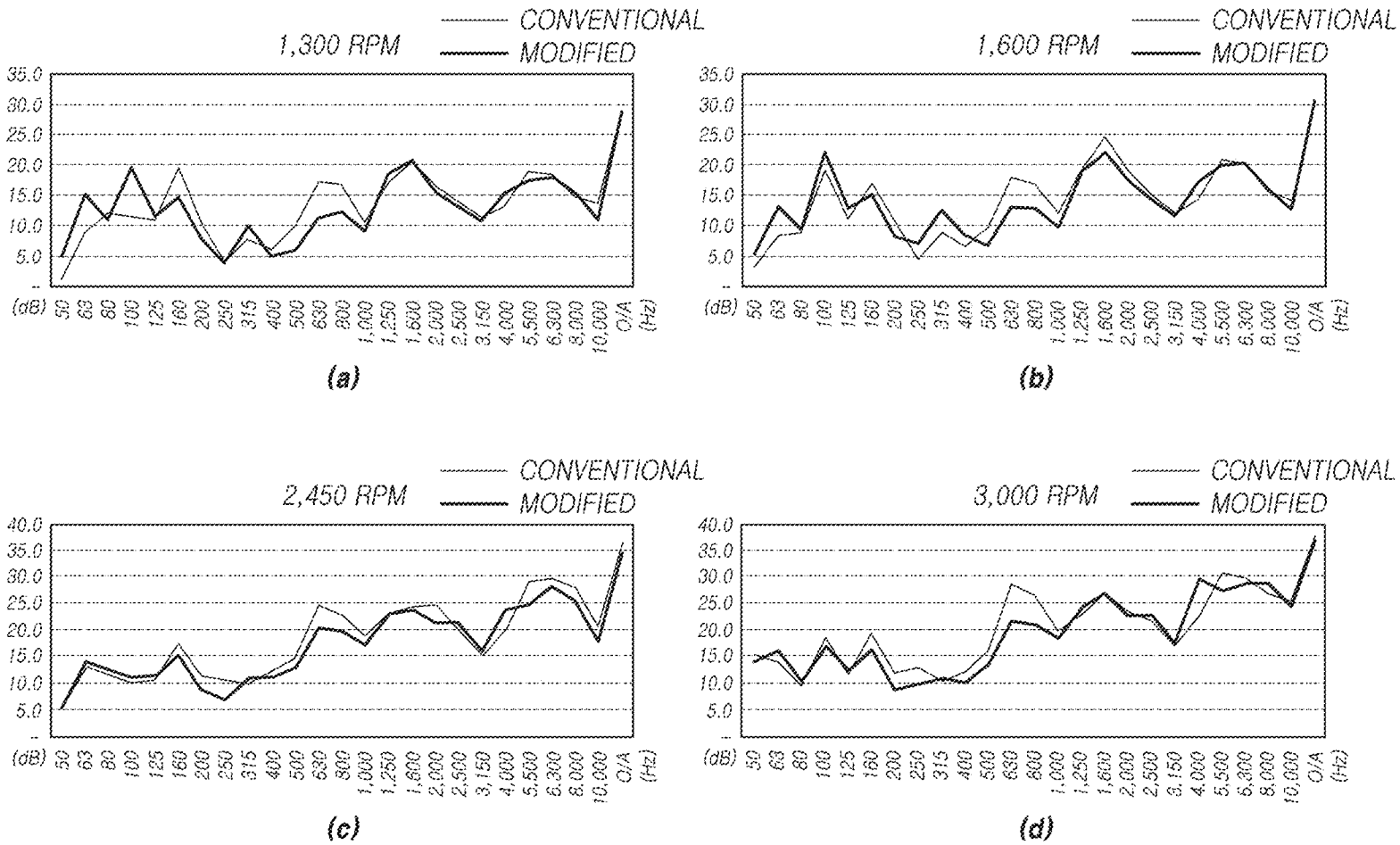
FIG. 9 is a graph illustrating noise according to a frequency band per revolutions per minute (RPM) of a motor, generated when a compressor operates according to an example of the disclosure.

FIG. 9 is a graph illustrating noise according to a frequency band per RPM of a motor, generated when a compressor operates according to an example embodiment of the disclosure.

Referring to FIGS. 7 and 8, the oil pickup part 30 may be fixed to the main body of the compressor 1 (specifically, the coupling portion 121 of the lower insulator 12*b*) through the fixing portion 33. The pickup shaft 31 of the oil pickup part 30 may be received in the hollow portion 1411 of the rotation shaft 14.

When the compressor 1 operates, the rotation shaft 14 is rotated by the rotation of the motor 10, but the pickup shaft 31 is fixed to the main body of the compressor 1 and does not rotate. When the compressor 1 operates, vibration caused by rotation of the motor 10 may be transferred from the main body (e.g., the stator 11) of the compressor 1 to the pickup shaft 31 along the fixing portion 33 and the bridge portion 32 of the oil pickup part 30, and in this case, the inner circumferential side (e.g., surface) 1411*a* of the rotation shaft 14 and the outer circumferential side (e.g., surface) of the pickup shaft 31 collide to generate noise.

However, as described above, the bridge portion 32 of the oil pickup part 30 is bent multiple times to form the damper portion 321, and the damper portion 321 functions as a shock-absorbing member, attenuating the vibration transferred to the oil pickup part 30 when the compressor 1 operates. In this case, the collision frequency between the inner circumferential side (e.g., surface) 1411*a* of the rotation shaft 14 and the outer circumferential side (e.g., surface) of the pickup shaft 31 is reduced, and as a result, the abnormal noise caused by the collision is also reduced.

Parts (a) to (d) of FIG. 9 are graphs illustrating the noise (dB) according to the frequency (Hz) for each specific RPM of the motor 10, and the X-axis denotes the frequency while the Y-axis denotes the noise (dB).

It may be identified from FIG. 9 that if the motor 10 rotates at specific RPMs (e.g., 1300 RPM in part (a) of FIG. 9, 1600 RPM in part (b) of FIG. 9, 2450 RPM in part (c) of FIG. 9, and 3000 RPM in part (d) of FIG. 9), the modified structure, in which the damper portion 321 is formed in the bridge portion 32, reduces noise in the overall frequency band as compared with the conventional structure, in which no damper portion 321 is formed in the bridge portion 32. Further, it may be identified that noise reduction may be effectively achieved in a specific frequency band (e.g., 630 Hz to 800 Hz or 1000 Hz to 2000 Hz).

A compressor 1 according to an embodiment of the disclosure may comprise a case 2 storing oil in a lower portion thereof, a stator 11 disposed in the case 2, a rotor 13 rotated by an electromagnetic interaction with the stator 11, a rotation shaft 14 coupled with the rotor 13, and having a hollow portion 1411 therein, and an oil pickup part 30 having one end 30*a* received in the hollow portion 1411 and the other end 30*b* fixed to the stator 11. The oil pickup part 30 may include a bridge portion 32 connecting the one end 30*a* and the other end 30*b*, and at least a portion of which is bent multiple times.

According to an embodiment, the stator 11 may include a stator core 111 and an insulator 12*b* surrounding an upper portion or a lower portion of the stator core 111. The insulator 12*b* may include a coupling portion 121 where the other end 30*b* of the oil pickup part 30 is inserted.

According to an embodiment, the oil pickup part 30 may include a fixing protrusion 331 fittingly coupled to the coupling portion 121 at the other end 30*b*.

According to an embodiment, the oil pickup part 30 may include a pickup shaft 31 received in the hollow portion 1411 of the rotation shaft 14 at the one end 30*a* and having a spiral-shaped outer circumferential side (e.g., surface).

According to an embodiment, the fixing protrusion 331 and the pickup shaft 31 may be disposed parallel to each other.

According to an embodiment, a central shaft C1 of the pickup shaft 31 and a central shaft of the rotation shaft 14 may be disposed to substantially match (or correspond to) each other when the pickup shaft 31 is received in the hollow portion 1411.

According to an embodiment, the bridge portion 32 may include a damper portion 321 bent multiple times to have one shape among a wavy shape, a wrinkle shape, and a concavo-convex shape, a first connection portion 322 connecting the one end 30*a* and the damper portion 321, and a second connection portion 323 connecting the other end 30*b* and the damper portion 321.

According to an embodiment, a bending thickness t2 of the damper portion 321 may be larger than a thickness t1 of the first connection portion 322 or the second connection portion 323.

According to an embodiment, a sum of side (e.g., surface) lengths of the damper portion 321, the first connection portion 322, and the second connection portion 323 may be larger than a length of a virtual line connecting the one end 30*a* and the other end 30*b* of the oil pickup part 30.

According to an embodiment, a thickness of the bridge portion 32 may be set to 1 mm.

A home appliance including a refrigeration cycle for heat exchange with an outside using a refrigerant, according to an embodiment of the disclosure, may comprise a compressor 1 compressing the refrigerant. The compressor 1 may comprise a case 2 storing oil in a lower portion thereof, a stator 11 disposed in the case 2, a rotor 13 rotated by an electromagnetic interaction with the stator 11, a rotation shaft 14 coupled with the rotor 13, and having a hollow portion 1411 therein, and an oil pickup part 30 having one end 30*a* received in the hollow portion 1411 and the other end 30*b* fixed to the stator 11. The oil pickup part 30 may include a bridge portion 32 connecting the one end 30*a* and the other end 30*b*, and at least a portion of which is bent multiple times.

According to an embodiment, the stator 11 may include a stator core 111 and an insulator 12*b* surrounding an upper portion or a lower portion of the stator core 111. The insulator 12*b* may include a coupling portion 121 where the other end 30*b* of the oil pickup part 30 is inserted.

According to an embodiment, the oil pickup part 30 may include a fixing protrusion 331 fittingly coupled to the coupling portion 121 at the other end 30*b*.

According to an embodiment, the oil pickup part 30 may include a pickup shaft 31 received in the hollow portion 1411 of the rotation shaft 14 at the one end 30*a* and having a spiral-shaped outer circumferential side (e.g., surface).

According to an embodiment, the fixing protrusion 331 and the pickup shaft 31 may be disposed parallel to each other.

According to an embodiment, a central shaft C1 of the pickup shaft 31 and a central shaft of the rotation shaft 14 may be disposed to substantially match (or correspond to) each other when the pickup shaft 31 is received in the hollow portion 1411.

According to an embodiment, the bridge portion 32 may include a damper portion 321 bent multiple times to have one shape among a wavy shape, a wrinkle shape, and a concavo-convex shape, a first connection portion 322 connecting the one end 30*a* and the damper portion 321, and a second connection portion 323 connecting the other end 30*b* and the damper portion 321.

According to an embodiment, a bending thickness t2 of the damper portion 321 may be larger than a thickness t1 of the first connection portion 322 or the second connection portion 323.

According to an embodiment, a sum of side (e.g., surface) lengths of the damper portion 321, the first connection portion 322, and the second connection portion 323 may be larger than a length of a virtual line connecting the one end 30*a* and the other end 30*b* of the oil pickup part 30.

According to an embodiment, a thickness of the bridge portion 32 may be set to 1 mm.

According to an embodiment, the stator 11 may include a stator core 111 having a cylindrical shape.

According to an embodiment, the stator 111 may be coupled to a lower side of a cylinder block 20 through a fastening member.

According to an embodiment, the bridge portion 32 of the oil pickup part 30 connecting a fixing portion 33 fixed to main body of the compressor 1 and a pickup shaft 31 received in the hollow portion 1411 of the rotation shaft 141.

What is claimed is:

1. A compressor, comprising:
a case storing oil in a lower portion thereof;
a stator disposed in the case;
a rotor rotated by an electromagnetic interaction with the stator;
a rotation shaft coupled with the rotor, and having a hollow portion therein; and
an oil pickup part having a first end received in the hollow portion and a second end fixed to the stator,
wherein the oil pickup part includes:
a pickup shaft received in the hollow portion of the rotation shaft at the first end; and
a bridge portion connecting the pickup shaft and the second end and extending integrally from the pickup shaft, and
wherein the bridge portion includes;
a damper portion formed by multiple alternating bends;
a first connection portion connecting the first end and the damper portion; and
a second connection portion connecting the second end and the damper portion.

2. The compressor of claim 1,
wherein the stator includes a stator core and an insulator surrounding an upper portion and a lower portion of the stator core, and
wherein the insulator includes a coupling portion where the second end of the oil pickup part is inserted.

3. The compressor of claim 2, wherein the oil pickup part further includes a fixing protrusion fittingly coupled to the coupling portion at the second end.

4. The compressor of claim 3, wherein the pickup shaft includes a spiral-shaped outer circumferential side.

5. The compressor of claim 4, wherein the fixing protrusion and the pickup shaft are disposed parallel to each other.

6. The compressor of claim 4, wherein a central shaft of the pickup shaft and a central shaft of the rotation shaft are disposed to substantially match each other when the pickup shaft is received in the hollow portion.

7. The compressor of claim 1, wherein a bending thickness of the damper portion is larger than a thickness of the first connection portion or the second connection portion.

8. The compressor of claim 1, wherein a sum of side lengths of the damper portion, the first connection portion, and the second connection portion is larger than a length of a virtual line connecting the first end and the second end of the oil pickup part.

9. The compressor of claim 1, wherein a thickness of the bridge portion is 1 millimeter (mm).

10. The compressor of claim 1, wherein a bending thickness of the damper portion is larger than a thickness of the first connection portion connecting the first end and the damper portion and a thickness of the second connection portion connecting the second end and the damper portion.

11. A home appliance comprising:
a compressor compressing a refrigerant,
wherein the compressor comprises:
a case storing oil in a lower portion thereof,
a stator disposed in the case,
a rotor rotated by an electromagnetic interaction with the stator,
a rotation shaft coupled with the rotor, and having a hollow portion therein, and
an oil pickup part having a first end received in the hollow portion and a second end fixed to the stator,
wherein the oil pickup part includes:
a pickup shaft received in the hollow portion of the rotation shaft at the first end; and
a bridge portion connecting the pickup shaft and the second end and extending integrally from the pickup shaft, and
wherein the bridge portion includes;
a damper portion formed by multiple alternating bends;
a first connection portion connecting the first end and the damper portion; and
a second connection portion connecting the second end and the damper portion.

12. The home appliance of claim 11,
wherein the stator includes a stator core and an insulator surrounding an upper portion or a lower portion of the stator core, and
wherein the insulator includes a coupling portion where the second end of the oil pickup part is inserted.

13. The home appliance of claim 12, wherein the oil pickup part further includes a fixing protrusion fittingly coupled to the coupling portion at the second end.

14. The home appliance of claim 13, wherein the pickup shaft includes a spiral-shaped outer circumferential side.

15. The home appliance of claim 14, wherein the fixing protrusion and the pickup shaft are disposed parallel to each other.

16. The home appliance of claim 14, wherein a central shaft of the pickup shaft and a central shaft of the rotation shaft are disposed to substantially match each other when the pickup shaft is received in the hollow portion.

17. The home appliance of claim 11, wherein a bending thickness of the damper portion is larger than a thickness of the first connection portion or the second connection portion.

18. The home appliance of claim 11, wherein a sum of side lengths of the damper portion, the first connection portion, and the second connection portion is larger than a length of a virtual line connecting the first end and the second end of the oil pickup part.

19. The home appliance of claim 11, wherein a thickness of the bridge portion is 1 millimeter (mm).

20. The home appliance of claim 11, wherein the home appliance includes a refrigeration cycle for heat exchange with an outside using the refrigerant.

* * * * *